United States Patent [19]

Hussey

[11] 4,209,678

[45] Jun. 24, 1980

[54] PRESSURE SWITCH ACTUATOR

[75] Inventor: Dennis M. Hussey, Ross-on-Wye, England

[73] Assignee: The Haigh Engineering Company Limited, England

[21] Appl. No.: 786,875

[22] Filed: Apr. 12, 1977

[30] Foreign Application Priority Data

Apr. 27, 1976 [GB] United Kingdom ..... 16986/76

[51] Int. Cl.[2] ..... H01H 35/30

[52] U.S. Cl. ..... 200/81 R; 200/61.6; 200/81.4; 200/83 Z; 241/32.5

[58] Field of Search ..... 241/32.5; 200/42 R, 200/61.6, 81 R, 81 H, 83 B, 83 C, 83 R, 83 Z, 81.4, 81.5, 153 L, 153 LB

[56] References Cited

U.S. PATENT DOCUMENTS

| | | | |
|---|---|---|---|
| 2,657,397 | 11/1953 | Drew | 4/190 |
| 3,219,778 | 11/1965 | Treffeisen | 200/83 B |
| 3,900,710 | 8/1975 | Potter | 200/83 Z |
| 3,950,814 | 4/1976 | Fleischhauer | 200/83 Z |

*Primary Examiner*—Gerald P. Tolin
*Attorney, Agent, or Firm*—Luke J. Wilburn, Jr.; Wellington M. Manning, Jr.

[57] ABSTRACT

A switch, particularly for use in controlling the comminuter motor of a waste disposal unit, which provides pressure pulses, for use in the electrical control circuit of the motor, by compressing one or more resilient members in sequence when operated.

4 Claims, 2 Drawing Figures

PRESSURE SWITCH ACTUATOR

This invention is concerned with a switch for controlling, for example, electric motors and usable in wet or damp locations.

In the control of, for example, the electric motor driving the comminuter of waste disposal apparatus there is a danger that a control switch will be operated by a person with damp or wet hands with potentially serious consequences.

It is an object of the present invention to provide a control switch in which there is no electrical danger to a user.

The present invention is a switch including a resilient compressible member, a tube communicating with said member and an actuator movable from a first position, in which it does not engage the compressible member, to a second position in which it engages and compresses the member.

Preferably a pressure actuated electrical switch is connected to said tube.

Two such compressible members may be provided. Said actuator may comprise a rotary member having a cam surface engageable with the or each compressible member.

The present invention is also a motor control circuit incorporating a pressure actuated switch controlling energisation of the motor, the switch being connected by a tube to a resilient compressible member co-operable with a two position actuator, whereby the position of the actuator determines the energisation of the motor.

The motor may be the comminuter motor of a waste disposal apparatus.

An embodiment of the present invention will now be described, by way of example, with reference to accompanying drawing, in which.

Figure 1:
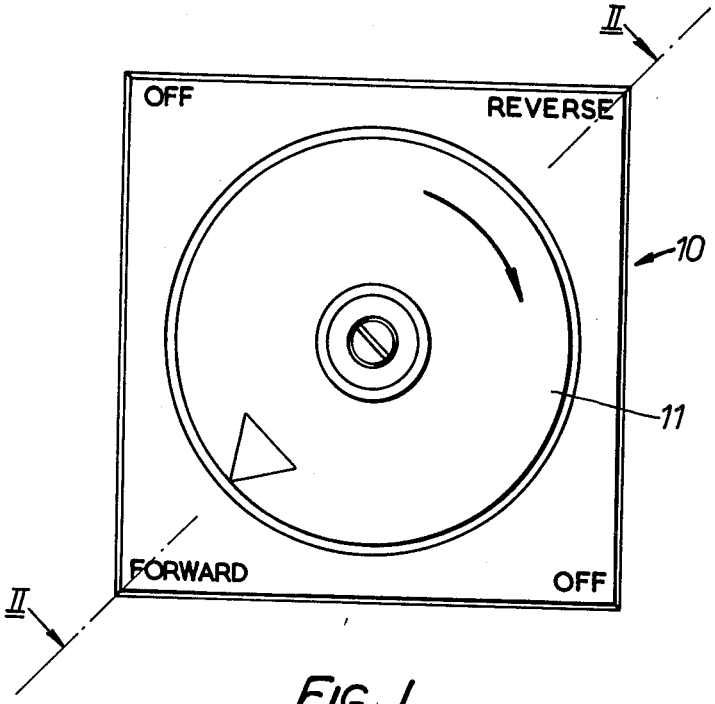
FIG. 1 is an external plan view of a switch.

Referring now to FIG. 1, a switch 10 has a rotary control knob 11 and four positions as marked.

Figure 2:
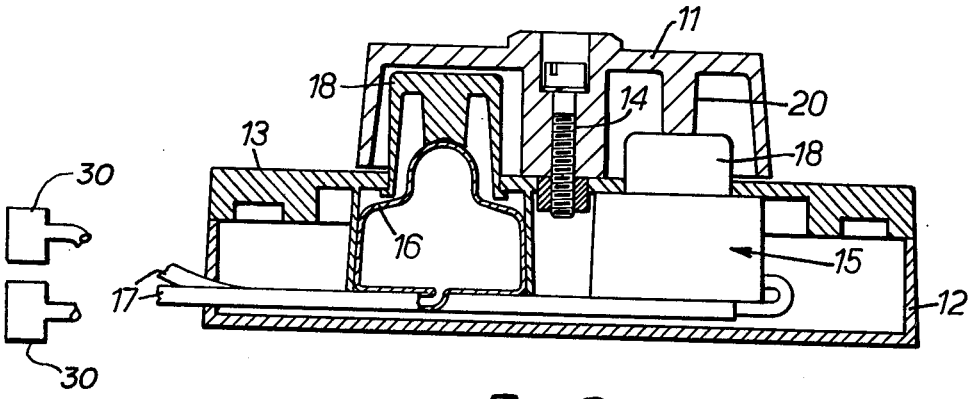
FIG. 2 is a sectional elevation on the line II—II of FIG. 1.

As seen in FIG. 2, the switch has a base 12 and a cover 13 on which the knob 11 is rotatable on an upright shaft 14. Two resilient compressible members 15 and 16 are mounted in opposite corners of the base 12 and correspond to the "forward" and "reverse" positions of the switch. Each member 15 and 16 has a capillary tube 17 communicating with its interior. Disposed over each member is a cover 18 which is movable through a hole in the cover 13 and is outwardly biased by the respective member 15 or 16.

On the underside of the knob 11 is formed a cam surface 20 which is engageable with the upper surfaces of the covers 18 to drive them towards the base 12 and thus compress the members 15 and 16.

From the above description it can be seen that the switch has two positions in respective ones of which one of the members 15 and 16 are compressed and two intermediate or off positions in which neither of the members are compressed.

The switch is particularly intended to control the energisation of a reversible motor for, for example, a waste disposal apparatus. In the control circuit of the motor are provided two pressure responsive switches 30 controlling respectively forward and reverse operation of the motor. The switches are connected to the respective one of the tubes 17 and are actuated by the pressure increase caused by compression of the respective one of the members 15 and 16.

It should be noted that the embodiment described provides control of an electric motor and yet poses no problems of electrical safety to an operator with wet hands.

I claim:

1. A pressure switch actuator comprising at least one resilient compressible member, said at least one compressible member having a protectable cover located thereabout, a tube communicating with each said member and being connectable to a pressure switch, and a rotary member rotatable from a first position in which it does not affect said compressible member to a second position in which it causes compression of said compressible member, said rotary member having a cam surface which contacts said protectable cover to effect compression of said compressible member in the second position.

2. A switch as claimed in claim 1, in which a pressure actuated electrical switch is connected to said tube.

3. A switch actuator as defined in claim 1 wherein two compressible members are provided and wherein the tubes in communication with each compressible member are connectable to different pressure switches.

4. A switch actuator as defined in claim 3 wherein one of said tubes is connectable to a forward pressure switch and the other of said tubes is connectable to a reverse pressure switch.

* * * * *